US006789703B2

(12) United States Patent
Pierre-Louis

(10) Patent No.: US 6,789,703 B2
(45) Date of Patent: Sep. 14, 2004

(54) TOOTHPASTE HOLDER AND DISPENSER

(76) Inventor: Jean Pierre-Louis, 3651 NW. 80th Ave., Coral Springs, FL (US) 33065

( * ) Notice: Subject to any disclaimer, the term of this patent is extended or adjusted under 35 U.S.C. 154(b) by 0 days.

(21) Appl. No.: 10/347,742

(22) Filed: Jan. 17, 2003

(65) Prior Publication Data

US 2003/0164383 A1 Sep. 4, 2003

Related U.S. Application Data

(60) Provisional application No. 60/350,133, filed on Jan. 18, 2002.

(51) Int. Cl.[7] ..... B65D 35/28
(52) U.S. Cl. ..... 222/101; 222/93
(58) Field of Search ..... 222/101, 93

(56) References Cited

U.S. PATENT DOCUMENTS 1,514,018 A * 11/1924 Sharpe ..... 222/93
1,869,685 A * 8/1932 Gusdorf ..... 222/96
2,056,422 A * 10/1936 Crossley ..... 222/101
2,570,755 A * 10/1951 Booth ..... 222/96
4,019,655 A * 4/1977 Moeller ..... 222/96
4,331,265 A * 5/1982 Warlick ..... 222/101
4,448,329 A * 5/1984 Vilaseca et al. ..... 222/96
4,575,375 A * 3/1986 Kozam ..... 604/185

FOREIGN PATENT DOCUMENTS

WO WO 94/19252 * 9/1994 ..... B65D/35/28

* cited by examiner

*Primary Examiner*—Melvin A. Cartagena
(74) *Attorney, Agent, or Firm*—Robert M. Downey, P.A.

(57) ABSTRACT

A toothpaste dispenser holds a collapsible tube of toothpaste within a housing between a roller assembly and a wall surface. A plunger is operable from a relaxed, raised position to a lowered, depressed position to drivingly engage the roller assembly so that one or more rollers are moved along the toothpaste tube in a manner which squeezes toothpaste out of the tube and onto the bristles of a toothbrush held in close proximity to a dispensing outlet of the tube or a nozzle. A spring returns the plunger to the relaxed, raised position upon removing the downward force. The housing is provided with toothbrush holders and a removable cover to permit replacement of the tube of toothpaste.

9 Claims, 9 Drawing Sheets

TOOTHPASTE HOLDER AND DISPENSER

This application claims the benefit of provisional 60/350,133 filed Jan. 18, 2002.

BACKGROUND OF THE INVENTION

1. Field of the Invention

This invention relates to dispensers and, more particularly, to an improved dispenser for holding a collapsible tube of toothpaste and mechanically dispensing the paste by controlled action of a depressible plunger.

2. Discussion of the Related Art

Heretofore, there have been numerous dispensers for use in conjunction with collapsible paste tubes. These dispensers, and particularly toothpaste dispensers, have incorporated mechanical mechanisms of various types which serve the purpose of squeezing the paste from the tube. Many of these dispensers use pinch rollers positioned on opposite sides of the collapsible toothpaste tube. The pinch rollers are generally driven through a gear arrangement upon rotation of a knob on the exterior of the device. Examples of toothpaste dispensers in the related art are seen in the U.S. patents to Mirka, U.S. Pat. No. 3,417,902; Smith, U.S. Pat. No. 4,629,095; Eiskant, U.S. Pat. No. 5,195,659; and Williams, U.S. Pat. No. 5,397,030.

The present invention provides an improvement to toothpaste dispensers. More specifically, the present invention incorporates use of a depressible plunger which drivingly engages a roller assembly to squeeze toothpaste from the tube and onto the bristles of a toothbrush in a controlled action, without jamming or excess play between movement of the plunger and discharge of the paste.

OBJECTS AND ADVANTAGES OF THE INVENTION

It is a primary object of the present invention to provide an improved dispenser for holding a collapsible tube of toothpaste and which is structured and disposed to dispense the paste in a controlled action without waste.

It is still a further object of the present invention to provide an improved dispenser for holding a collapsible tube of toothpaste and for mechanically dispensing the toothpaste by controlled action of a depressible plunger.

It is yet a further object of the present invention to provide an improved dispenser for holding and dispensing toothpaste from a collapsible tube, and wherein the dispenser is easy to operate.

It is still a further object of the present invention to provide an improved dispenser for dispensing toothpaste from a collapsible tube, and wherein the dispenser device is structured and disposed for ease of replacement of tubes of toothpaste.

It is still a further object of the present invention to provide an improved dispenser for holding a collapsible tube of toothpaste and for mechanically dispensing the toothpaste by controlled action of a depressible plunger, and wherein the dispenser is inexpensive to manufacture, thereby making the dispenser easily affordable to most households.

These and other objects and advantages of the present invention are more readily apparent with reference to the following detailed description and the accompanying drawings.

SUMMARY OF THE INVENTION

The present invention is directed to a toothpaste dispenser which is structured to hold a collapsible tube of toothpaste within a housing between a roller assembly and a wall surface. Operation of a plunger from a relaxed, raised position to a lowered, depressed position serves to operatively engage a roller assembly, thereby causing one or more rollers of the roller assembly to move along the toothpaste tube in a manner which squeezes toothpaste out of the tube and onto the bristles of a toothbrush held in close proximity to a dispensing outlet of the toothpaste tube or a nozzle connected to the toothpaste tube. A spring returns the plunger to the relaxed, raised position upon removing the downward force. Each time the plunger is depressed, the roller assembly moves along a linear path, in forced engagement with the tube of toothpaste. A pivotal locking cam on the roller assembly permits return movement of the plunger to the relaxed, raised position while preventing reverse movement of the roller assembly. The housing is provided with toothbrush holders and a removable cover to permit removal and replacement of tubes of toothpaste within the housing interior.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
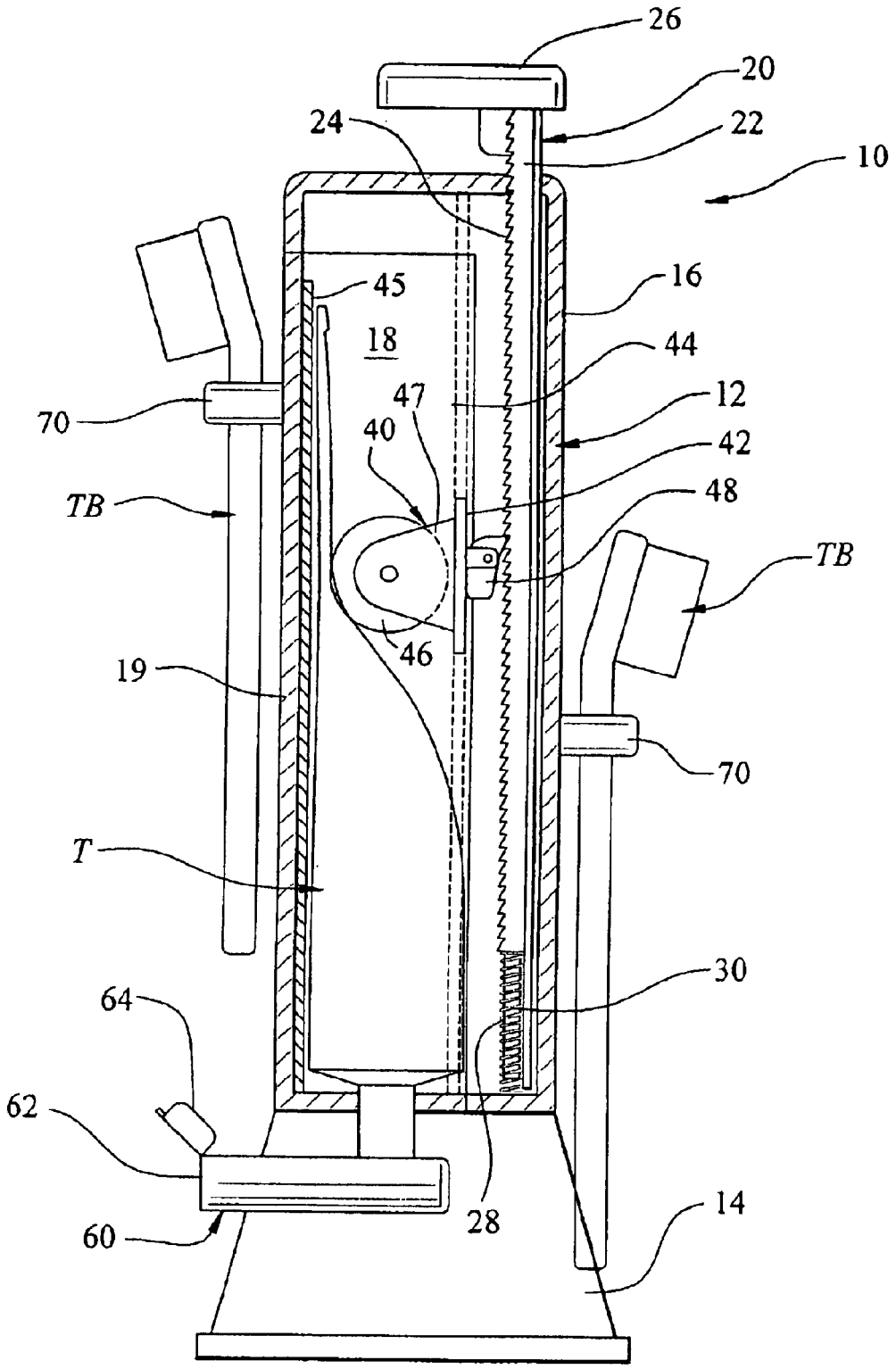
FIG. 1 is a side elevational view, in cross section, showing the assembled toothpaste dispenser, with a collapsible tube of toothpaste therein, in accordance with a first embodiment thereof.
Figure 2:
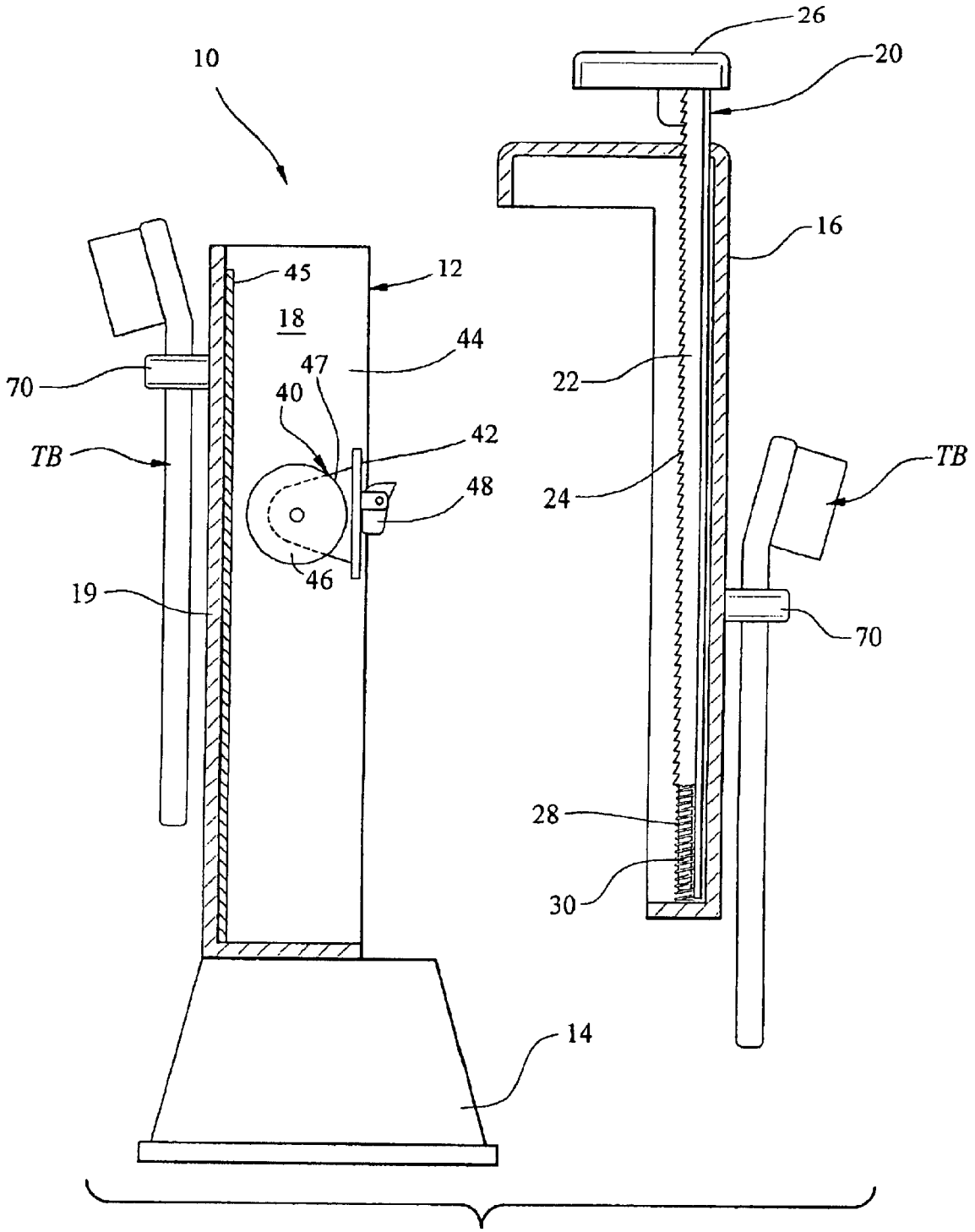
FIG. 2 is a partially exploded view of the dispenser of FIG. 1, showing a cover and plunger removed from a remainder of the dispenser housing.
Figure 3:
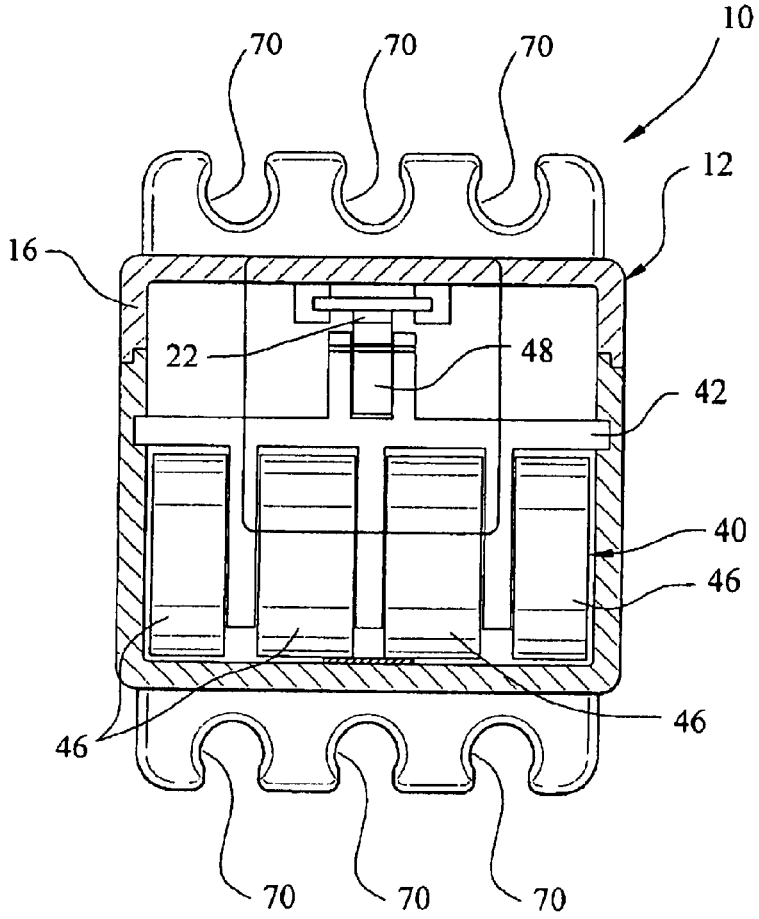
FIG. 3 is a top plan view of the dispenser of FIG. 1.
Figure 4:
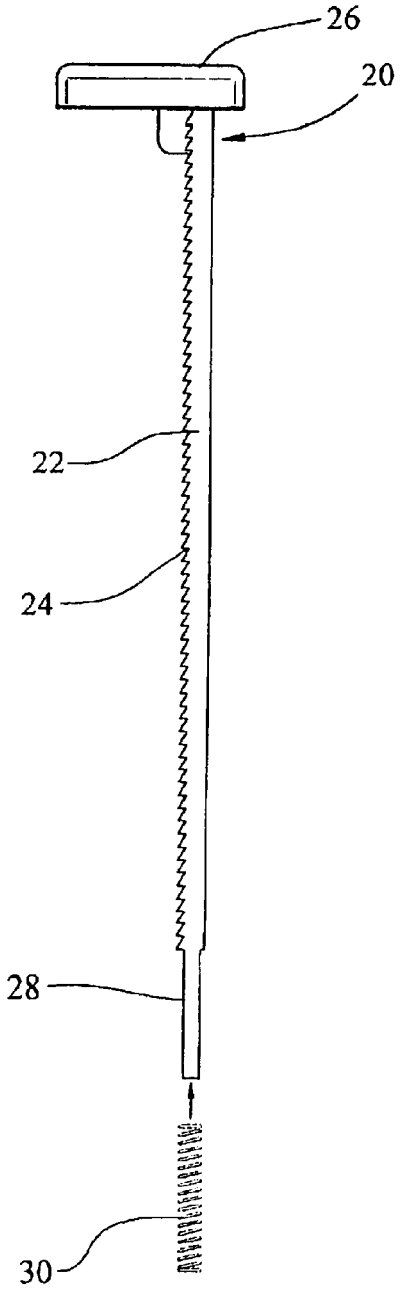
FIG. 4 is an isolated elevational view showing the plunger and spring of the dispenser of FIG. 1.
Figure 5:
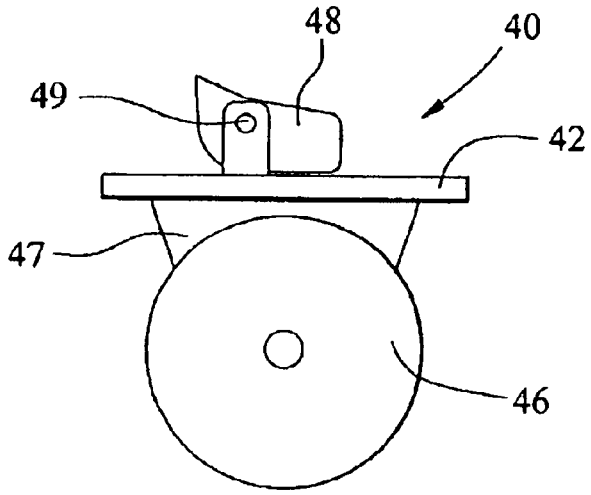
FIG. 5 is an isolated side elevational view of the roller assembly of the dispenser of FIG. 1.
Figure 6:
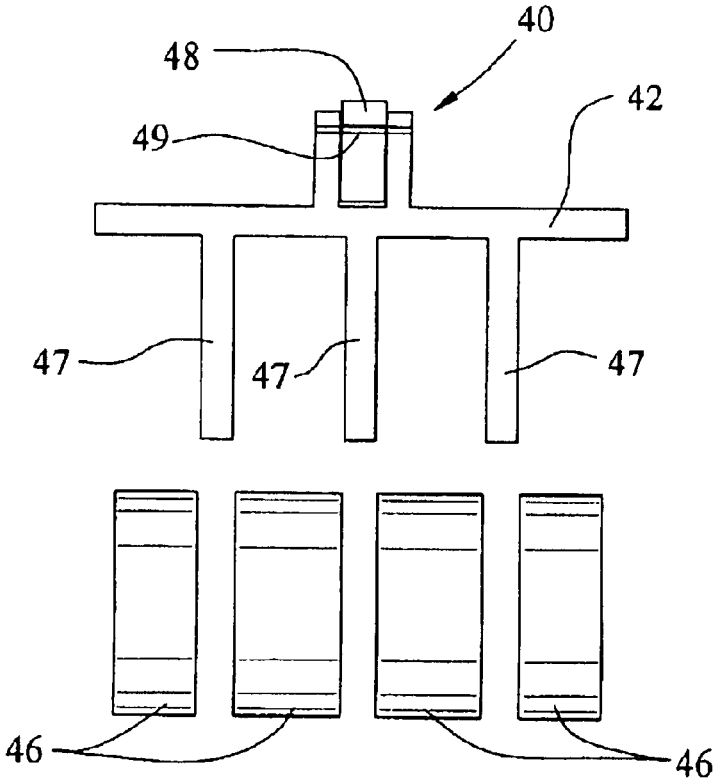
FIG. 6 is a partially exploded view of the roller assembly, showing four rollers separated from the roller brace.

Referring initially to FIGS. 1–6, a first preferred embodiment of the toothpaste dispenser device is shown and is generally indicated as 10. The dispenser 10 includes a housing 12 which is structured and configured to stand upright in a vertical orientation. The housing includes a support base 14 having a bottom which rests on a counter surface to support the housing in the upright position as shown in FIG. 1. The housing 12 further includes a removable cover 16 which provides access to an interior chamber 18 of the dispenser. The interior chamber is specifically sized and configured to accommodate a full tube of toothpaste T therein. More specifically, the tube of toothpaste T is of the conventional collapsible type which is squeezed from a bottom end towards a threaded neck to force the toothpaste contents outwardly from an open end of the threaded neck. When properly positioned within the interior chamber 18 of the housing 12, the collapsible tube of toothpaste T is arranged in an inverted position against interior wall surface 19, with the neck of the toothpaste tube positioned within the base 14. In this particular embodiment, a dispensing nozzle 60 is fitted to the threaded neck of the toothpaste tube and extends horizontally and outward from the base 14 to advantageously position a dispensing outlet 62 outwardly away from the base so that the bristles of a toothbrush can be positioned below the dispensing outlet 62. After use, a hinged cap 64 can be closed to cover the dispensing outlet 62, thereby preventing the toothpaste from drying within the dispensing nozzle 60.

The dispenser 10 is further provided with a plunger actuator assembly including a plunger 20 moveably fitted within the housing and extending outwardly through the top end of the housing. More specifically, the plunger 20 includes an elongate stem 22 which extends downwardly from a platform 26 on the top end of the plunger 20 and down through the top of the housing for guided, moving receipt within a guide track formed in the housing. A lower end 28 of the elongate stem is provided with a spring 30 which urges the plunger upward to a normally relaxed position with the platform 26 raised in spaced relation above the top of the housing, as seen in FIG. 1. The plunger 22 is further provided with a tooth rack gear along the stem 22. The tooth rack gear is structured and disposed for operative engagement with a roller assembly 40 as described more fully hereinafter.

The roller assembly 40 is moveably fitted with the interior chamber 18 of the housing and includes a traveler 42 slidably received within a guide track 44 of the housing, permitting sliding, vertical movement of the roller assembly 40 within the interior chamber 18. The traveler 42 is provided with brace members 47 which extend outwardly, in spaced relation to one another, to support one or more rollers 46. Each of the rollers 46 is structured and disposed for rolling, pressing engagement against the collapsible tube of toothpaste T so that as the roller assembly moves downwardly within the interior chamber 18, the rollers 46 press the collapsible tube T against the wall surface 19 causing the toothpaste contents within the collapsible tube to be pushed downwardly towards the nozzle 60. Continued downward movement of the roller assembly 40 causes the rollers to squeeze the toothpaste out from the collapsible tube, through the nozzle 60 and out from the dispensing outlet 62 for deposit onto the bristles of a toothbrush held below the open dispensing outlet 62 of the nozzle 60.

As mentioned above, the tooth rack gear 24 of the plunger 22 operatively engages the roller assembly 40 to urge the roller assembly 40 downwardly within the interior chamber 18 so that the rollers 46 are moved along the collapsible tube to squeeze the toothpaste outwardly from the dispensing nozzle. More specifically, the teeth of the rack gear are structured and disposed for engagement with a pivoting locking cam 48 secured to the back side of the traveler 42 by pivot pin 49. The locking cam 48 is specifically structured and disposed to engage the teeth of the rack gear 24 upon downward movement of the plunger from a relaxed, raised position to a lowered, depressed position. Further, the locking cam 48 engages the teeth of the rack gear 24 when the roller assembly 40 is urged in the reverse, upward direction within the housing 18. However, upon upward return movement of the plunger 20 from the lowered, depressed position to the relaxed, raised position, the locking cam 48 disengages from the teeth. More specifically, when the rack gear moves upwardly to its relaxed position, the locking cam 48 pivots, allowing the teeth to disengage from the locking cam 48.

In operation, a downward force is exerted on the platform 26 of the plunger 20, causing the rack gear 24 to move downwardly and engage the locking cam 48. This results in the roller assembly 40 being pushed downwardly as the rollers 46 travel in forced engagement along the tube of toothpaste T, squeezing the toothpaste contents out through the open dispensing outlet 62 of the nozzle 60. When the plunger 20 reaches the lowered, depressed position, the spring 30 is compressed so that upon removing the downward force from the top platform 26, the spring 30 urges the plunger 20 upwardly to return to the relaxed, raised position. Upon upward movement of the plunger 20, the roller assembly 40 remains in a fixed position relative to the tube of toothpaste. With each downward movement of the plunger, the roller assembly 40 is moved downwardly within the interior chamber 18 towards the neck of the tube of toothpaste. It should be noted that the rollers 46 remain in pressed engagement with the collapsible tube of toothpaste T, and against the preceding bulge in the tube which contains the toothpaste contents. With each successive forced depression of the plunger 20 from the raised position to the lower position, the rollers 46 of the roller assembly 40 squeeze the toothpaste contents of the collapsible tube towards the neck of the toothpaste tube and through the nozzle 60. Because the roller assembly 40 remains stationary upon return of the plunger 20 from the lowered position to the raised position, there is no play between the rollers 46 and the bulge of toothpaste within the collapsible tube on the next successive downward depression of the plunger 20. Accordingly, once the toothpaste has filled the nozzle, each of the successive downward operations of the plunger 20 results in immediate dispensing of toothpaste from the open end of the dispensing outlet 62. This permits controlled dispensing of the toothpaste onto the bristles of a toothbrush with slow downward depression of the plunger 20.

When the roller assembly 40 has reached the bottom of the interior chamber 18, the toothpaste contents of the collapsible tube have been substantially emptied. A new tube of toothpaste can then be replaced within the interior chamber 18 by removing the cover 16, with plunger 20, from the remainder of the housing 12. The roller assembly 40 is then moved to the raised position by sliding the traveler 42 upwardly along the guide track 44 until the roller assembly is to a fully raised position. A new tube of toothpaste can then be inserted into the interior chamber 18 so that the end of the tube is pinched between the rollers 46 and the wall surface 19. When properly positioned, the tube of toothpaste should rest within the interior chamber 18 with the neck of the toothpaste tube extending downwardly into the base for connection with the nozzle 60 as seen in FIG. 1. Once the cover 16 is reattached to the housing, the plunger 20 can be actuated in successive downward and return upward movements until toothpaste begins to exit the open end of the dispensing outlet 62.

Figure 7:
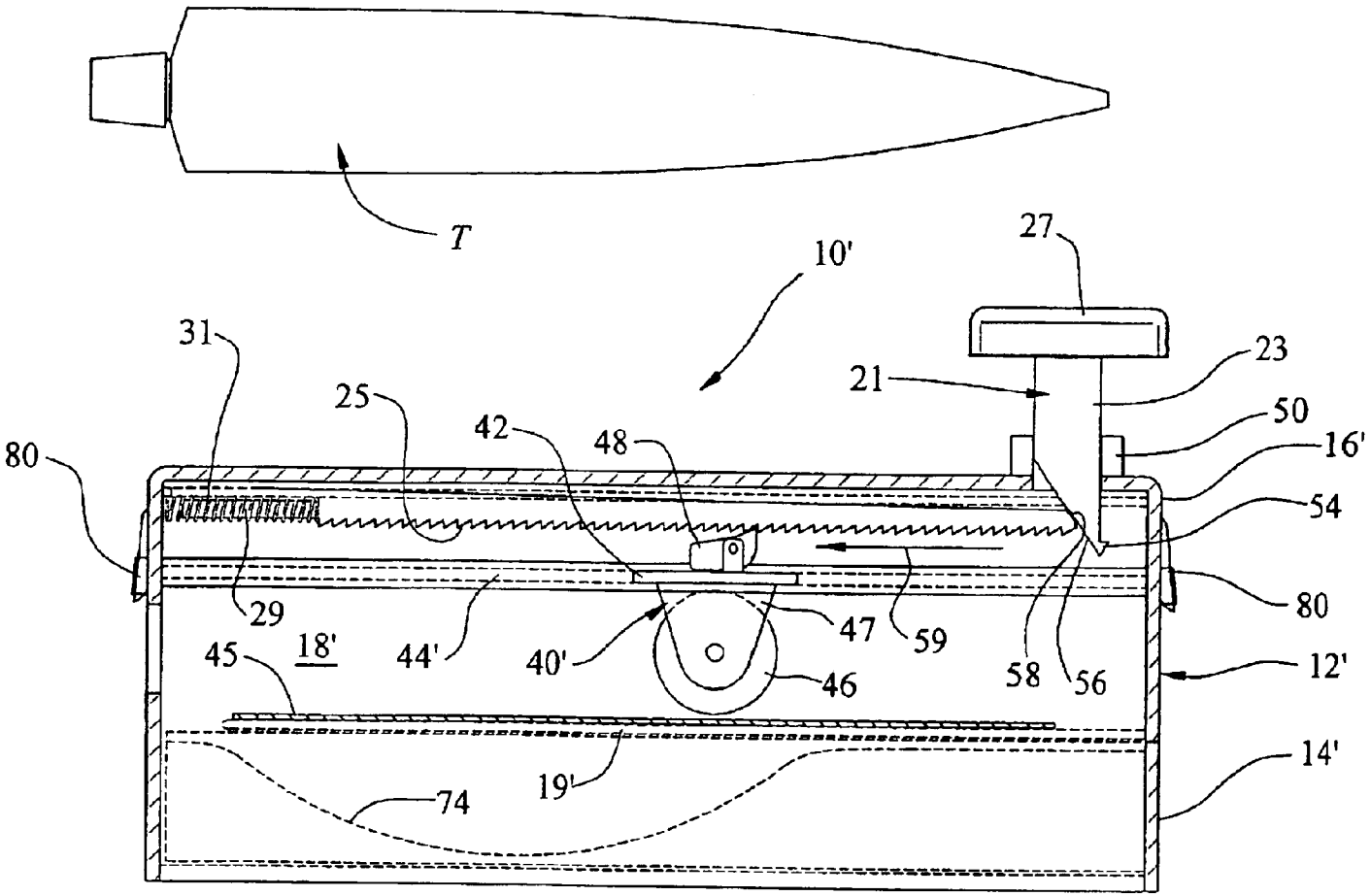
FIG. 7 is a side elevational view, in partial section, illustrating an alternative embodiment of the toothpaste dispenser of the present invention.
Figure 8:
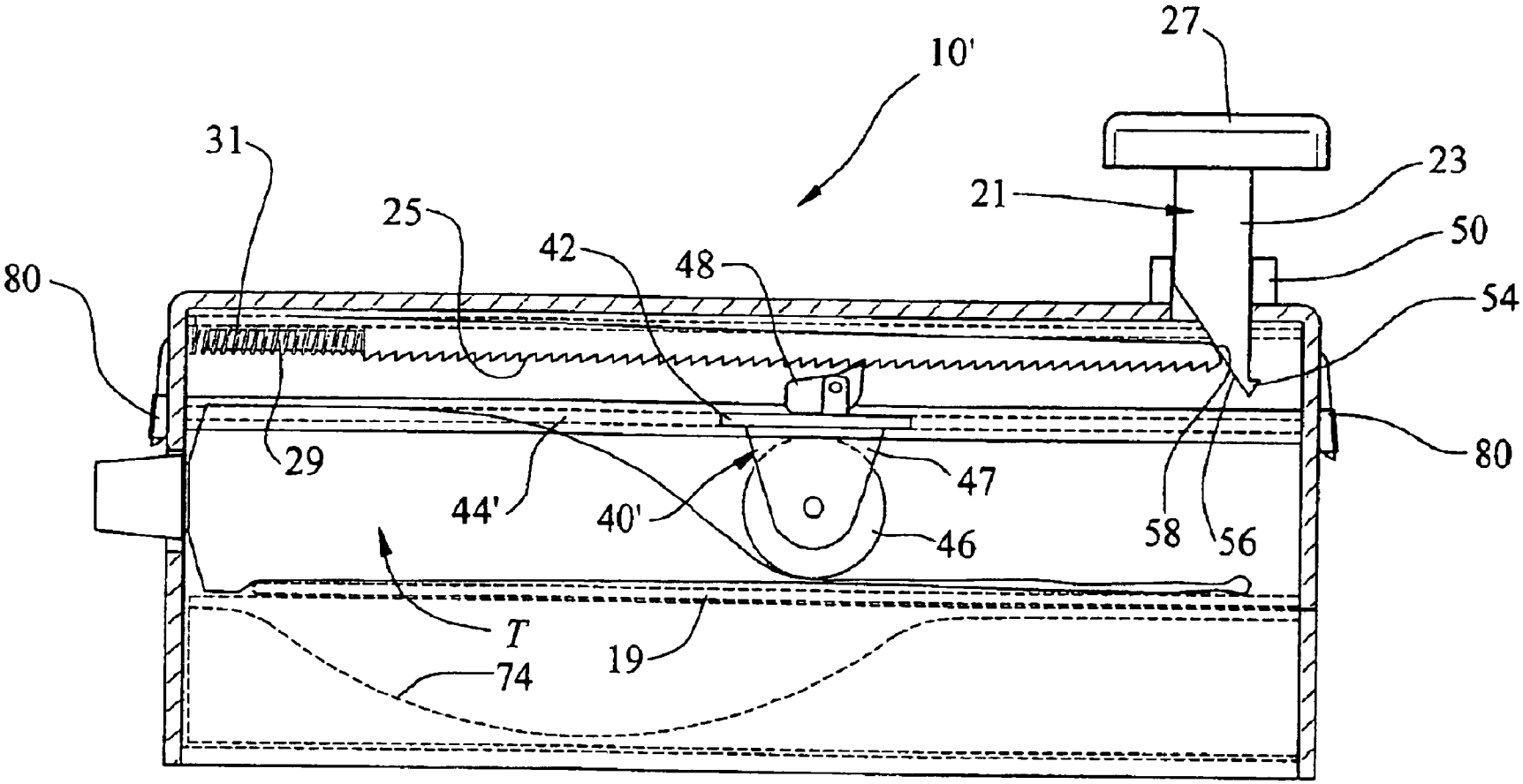
FIG. 8 is a side elevational view, in partial section, showing the toothpaste dispenser of FIG. 7 with a collapsible tube of toothpaste placed within the dispenser and operatively engaged with the roller assembly.

Referring to FIGS. 7–12, a second preferred embodiment of the toothpaste dispenser device is shown and is generally indicated as 10'. In this particular embodiment, the housing 12' is structured and disposed to rest in a generally horizontal orientation and includes a base 14' and a removable cover portion 16'. Similar to the previous embodiment, the cover portion 16' removes from the base 14' to permit placement of the collapsible toothpaste tube T within the interior chamber 18' so that the tube T rests on the wall surface 19', as seen in FIG. 8. When properly positioned within the device, the neck of the tube of toothpaste T extends outwardly from the end of the housing. The cap C is easily removed from the threaded neck of the toothpaste tube when it is desired to dispense toothpaste onto a toothbrush.

Figure 9:
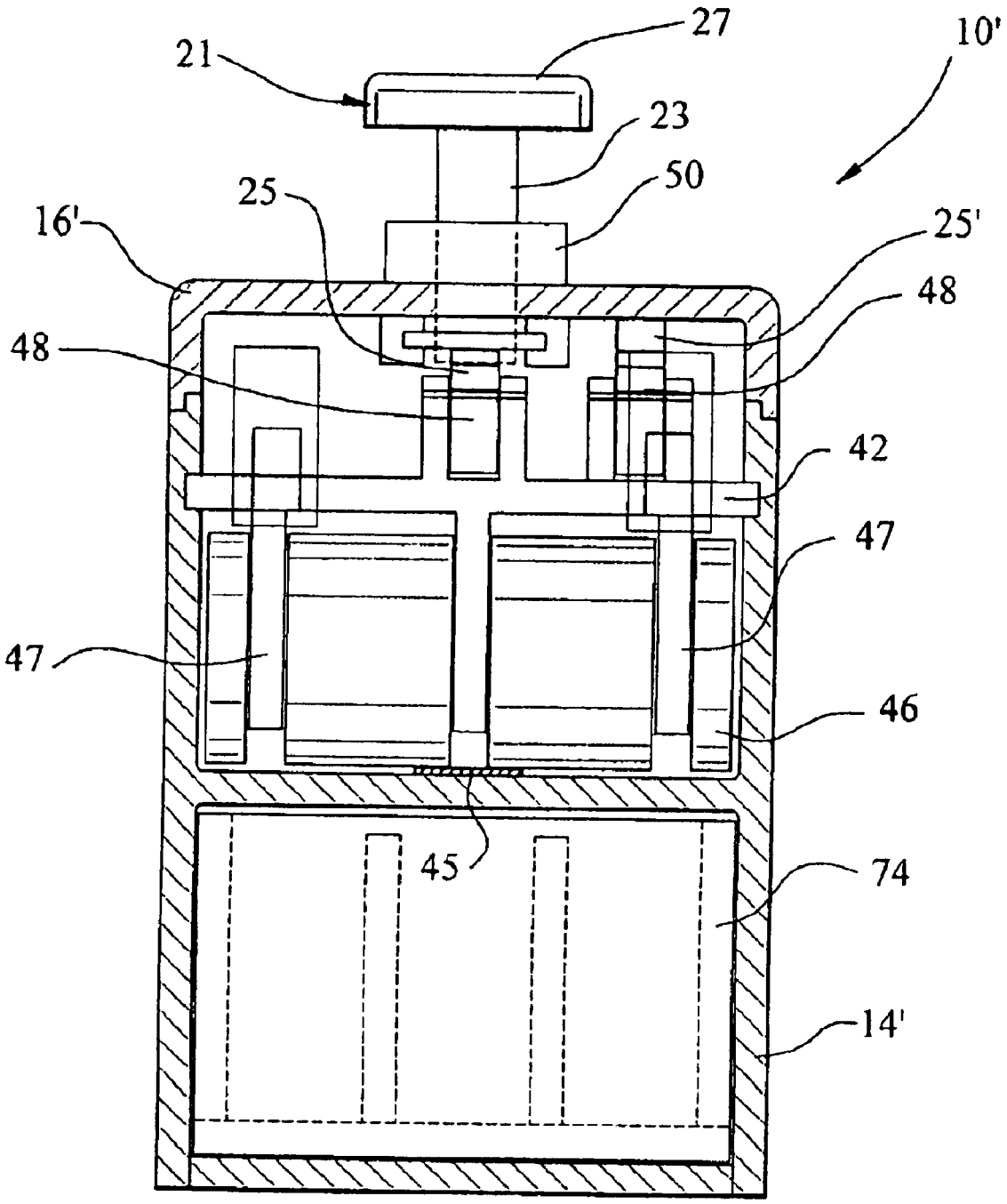
FIG. 9 is an end elevational view of the dispenser of FIG. 7 showing toothbrush holders and the roller assembly thereof.
Figure 10:
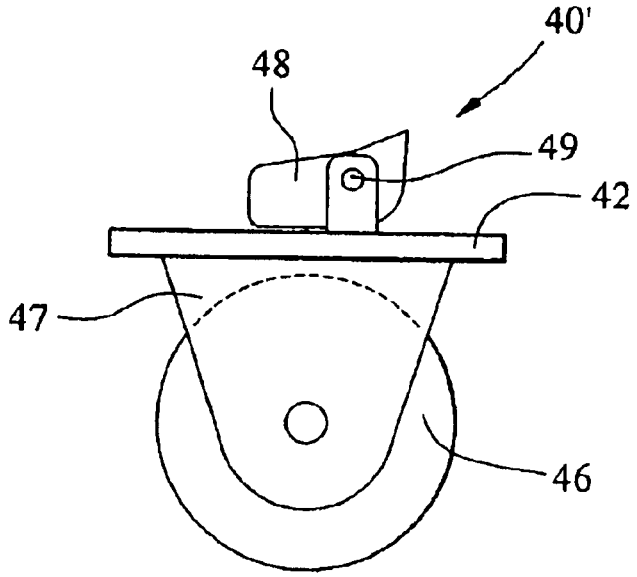
FIG. 10 is an isolated side elevational view of the roller assembly of the dispenser of FIG. 7.
Figure 11:
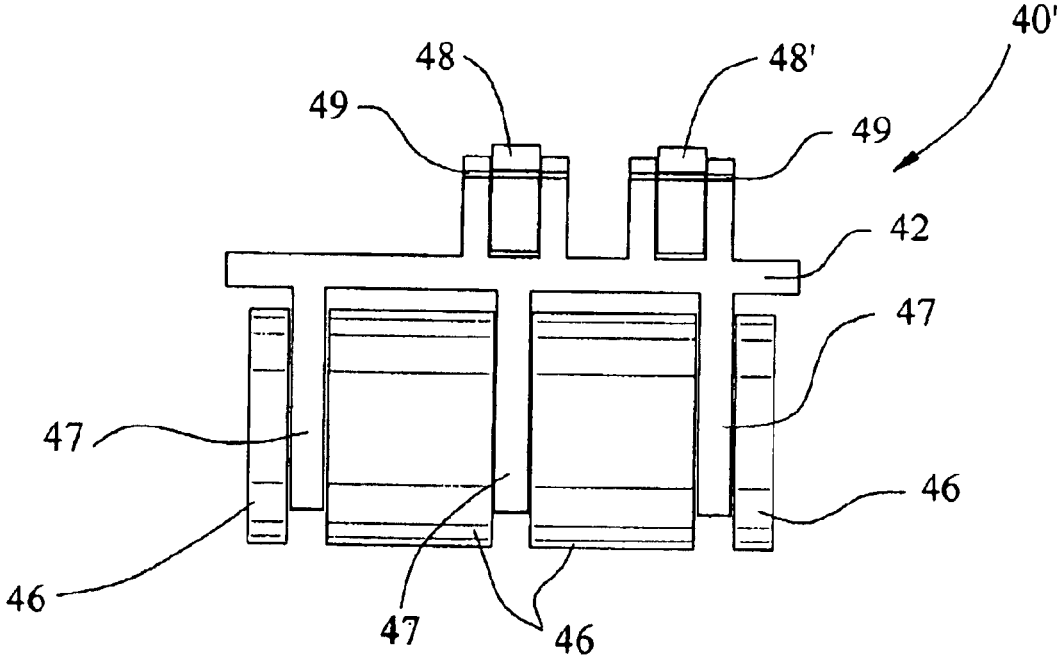
FIG. 11 is an isolated front elevational view of the roller assembly of FIG. 10.

Referring to FIGS. 7–9, a plunger 21 includes a stem portion 23 and an enlarged platform 27 for applying downward pressure on the plunger 21. The stem portion 23 extends through an opening 52 formed through the cover 16' and surrounded by an annular hub 50. A catch element 54 on the distal tip of the stem 23 captivates the plunger 21 on the cover 16' and prevents removal of the stem portion 23 out through the opening 52. The lower end portion of the stem portion 23 includes an angled surface 56 which abuts the end 58 of rack gear 25. Upon depressing the plunger 21, the angled surface 56 applies a linear force on the end 58 of the rack gear 25, causing the rack gear 25 to move in the direction of arrow 59, as seen in FIG. 7. Movement of the rack gear 25 in the direction of arrow 59 results in compression of spring 31 fitted to the opposite end 29 of the rack gear 25.

A roller assembly 40' is moveably fitted within the interior chamber 18' and in driven engagement with rack gear 25. Similar to the embodiment described above in connection with FIGS. 1–6, the roller assembly 40' includes a traveler 42 slidably fitted within a guide track 44' so as to be moveable horizontally along the length of the interior chamber 18'. Rollers 46 are rotatably mounted to brace members 47 of the traveler 42. As the traveler 42 moves horizontally along the length of the interior chamber 18', the rollers 46 pass in close, spaced relation to the wall surface 19'.

As mentioned above, the roller assembly 40' is drivingly engaged by the rack gear 25. More specifically, the teeth on the rack gear 25 engage locking cam 48 on the traveler 42 when the rack gear moves in the direction of the arrow 59, as seen in FIG. 7. Movement of the traveler 42, in response to driven engagement of the rack gear 25 with the locking cam 48, results in rolling engagement of the rollers 46 with the collapsible tube of toothpaste T as seen in FIG. 8. Continued advancement of the rollers 46 along the toothpaste tube T causes the collapsible tube of toothpaste T to be pinched between the rollers 49 and the wall surface 19', thereby resulting in the toothpaste contents being squeezed outwardly from the open neck of the toothpaste tube T.

With each downward operation of the plunger 21, the rack gear 25 is forced in the direction of arrow 59, against spring 31. Upon release of the downward force on platform 27 of the plunger 21, the spring 31 urges the rack gear 25 in the opposite direction of arrow 59, causing the end 58 of rack gear 25 to push against the angled surface 56 of the plunger stem 53, resulting in return of the plunger 21 to the raised, relaxed position. Each successive downward depression and release of the plunger 21 results in advancement of the roller assembly 40' along the chamber 18', while the rollers 46 maintain engagement against the toothpaste tube T.

Referring to FIG. 9, a fixed rack gear 25' is further provided for engagement with a second locking cam 48' on the traveler 42. Use of the fixed rack gear 25' and second locking cam 48' prevents reverse movement of the roller assembly 40' upon release of downward pressure on the plunger 21. More specifically, upon releasing downward pressure on the plunger 21, the rack gear 25 is urged to the relaxed position, in the opposite direction of the arrow 59. The locking cam 48 disengages from the teeth of the rack gear 25 to permit movement of the rack gear 25 to the relaxed position. When this happens, the bulge of toothpaste contents within the tube T exerts pressure on the rollers 46, urging the roller assembly 40' in a reverse direction, away from the neck of the toothpaste tube T. However, reverse movement of the roller assembly 40' is prevented due to engagement of locking cam 48' with the teeth of the fixed rack gear 25'. In this manner, slack or play between operation of the plunger 21 and movement of the rollers 46 against the bulge of toothpaste contents within the tube T is avoided. Accordingly, with each slight downward depression on the plunger 21, the toothpaste contents will immediately begin to exit the open threaded neck of the tube T, thereby providing for controlled and neat dispensing of a desired amount of toothpaste onto the bristles of a toothbrush held just below the open end of the threaded neck of the tube T.

Figure 12:
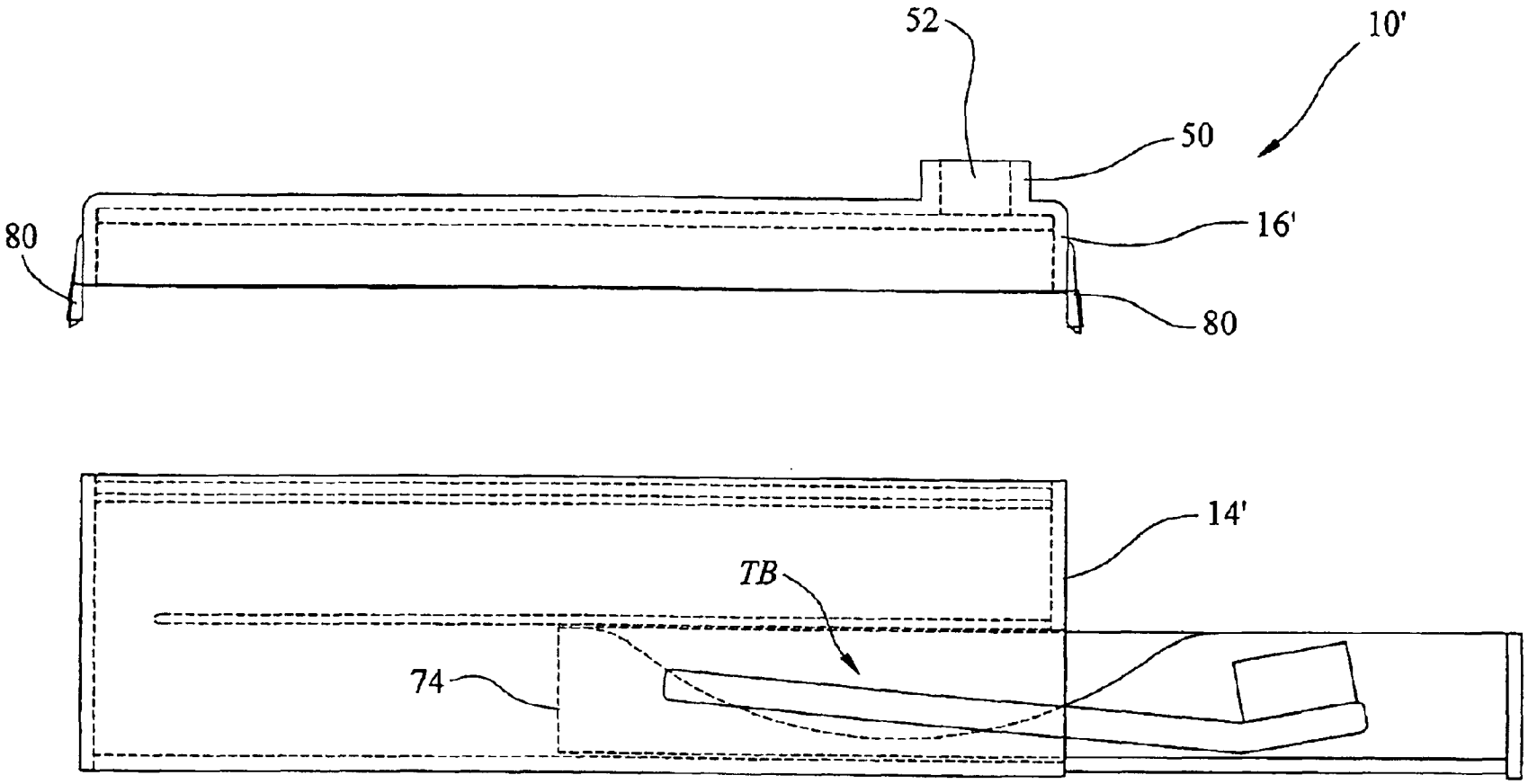
FIG. 12 is a side elevational view, in partial section, showing the housing of the dispenser assembly of FIG. 7 with a cover removed and a toothpaste received within one of the toothpaste holders thereof.

As best seen in FIGS. 9 and 12, the base 14' of the housing 12' is provided with toothbrush holders 70'. More specifically, holes 72 formed through the end walls of the housing permit passage of the handle of a toothbrush therethrough. Once the handle is inserted through the hole, the handle is able to rest on a platform 74 within the base 14' to support the handle of the brush, as seen in FIG. 12.

While the instant invention has been shown and described in accordance with preferred and practical embodiments of the present invention, it is recognized that departures from the instant disclosure are contemplated within the spirit and scope of the present invention.

What is claimed is:

1. A device for dispensing toothpaste from a collapsible tube having a discharge opening, said device comprising:

a housing including an interior chamber structured and disposed for holding a collapsible tube therein and said housing further including a wall surface within said interior chamber;

a roller assembly moveably disposed within said interior chamber of said housing and moveable relative to said wall surface, said roller assembly including at least one roller structured and disposed for engaging and pinching the collapsible tube between said roller and said wall surface;

an actuator assembly drivingly engaging said roller assembly and said actuator assembly being operable to move said roller assembly through a range of movement within said housing so that said at least one roller is moved relative to said wall surface and in engagement with the collapsible tube in a manner which urges a charge of the toothpaste out from the discharge opening of the collapsible tube;

a dispensing nozzle structured for releasable connection to the discharge opening of the collapsible tube for directing the dispensed charge of toothpaste therefrom and out from an open end of said dispensing nozzle exterior of said housing for deposit onto the bristles of a toothbrush positioned adjacent to the open end of said dispensing nozzle and exterior of said housing;

said actuator assembly including a plunger extending from said housing and including a platform positioned exterior of said housing and said plunger being operable from a relaxed, raised position to a depressed, lowered position, upon application of hand pressure against said platform;

said actuator assembly further including a near moved by operation of said plunger and said near drivingly engaging said roller assembly for moving said roller assembly through said range of movement upon operating said plunger from said relaxed, raised position to said depressed, lowered position; and a pivoting locking cam on said roller assembly disposed in driven engagement with said gear, and said locking cam being structured and disposed for driven engagement with said gear upon operation of said plunger from said raised position to said lowered position, and said locking cam being further structured to maintain engagement with said gear when said plunger is in said relaxed position to thereby hold said roller assembly stationary with said at least one roller in engagement with the collapsible tube and against a bulge in the collapsible tube formed by the toothpaste contents.

2. The device as recited in claim 1 wherein said housing includes a holder for holding at least one toothbrush.

3. The device as recited in claim 2 wherein said holder includes a sliding drawer structured and disposed for holding the at least one toothbrush therein.

4. The device as recited in claim 1 further comprising:

a longitudinal track within said housing; and a traveler on said roller assembly and moveably coupled to said longitudinal track for guiding movement of said roller assembly.

5. The device as recited in claim 1 further comprising:

a rubber strip on said wall surface for engaging said collapsible tube and discouraging movement of said collapsible tube relative to said wall surface upon movement of said roller assembly and said at least one roller against said collapsible tube.

6. A device for dispensing toothpaste from a collapsible tube having a discharge opening, said device comprising:

a housing including an interior chamber structured and disposed for holding a collapsible tube therein and said housing further including a wall surface within said interior chamber;

a roller assembly moveably disposed within said interior chamber of said housing and moveable relative to said wall surface, said roller assembly including at least one roller structured and disposed for engaging and pinching the collapsible tube between said roller and said wall surface;

an actuator assembly drivingly engaging said roller assembly and said actuator assembly being operable to move said roller assembly through a range of movement within said housing so that said at least one roller is moved relative to said wall surface and in engagement with the collapsible tube in a manner which urges a charge of the toothpaste out from the discharge opening of the collapsible tube;

a dispensing nozzle structured for releasable connection to the discharge opening of the collapsible tube for directing the dispensed charge of toothpaste therefrom and out from an open end of said dispensing nozzle exterior of said housing for deposit onto the bristles of a toothbrush positioned adjacent to the open end of said dispensing nozzle and exterior of said housing;

said actuator assembly including a plunger extending from said housing and including a platform positioned exterior of said housing and said plunger being operable from a relaxed, raised position to a depressed, lowered position, upon application of hand pressure against said platform;

said actuator assembly further including a gear moved by operation of said plunger and said gear drivingly engaging said roller assembly for moving said roller assembly through said range of movement upon operating said plunger from said relaxed, raised position to said depressed, lowered position; and a pivoting locking cam on said roller assembly disposed in driven engagement with said gear, and said locking cain being structured and disposed for driven engagement with said gear upon operation of said plunger from said raised position to said lowered position, and said locking cam being further structured to maintain engagement with said gear when said plunger is in said relaxed position to thereby hold said roller assembly stationary with said at least one roller in engagement with the collapsible tube and against a bulge in the collapsible tube formed by the toothpaste contents; and a rubber strip on said wall surface for engaging said collapsible tube and discharging movement of said collapsible tube relative to said wall surface upon movement of said roller assembly and said at least one roller against said collapsible tube.

7. The device as recited in claim 6 wherein said housing includes a holder for holding at least one toothbrush.

8. The device as recited in claim 7 wherein said holder includes a sliding drawer structured and disposed for holding the at least one toothbrush therein.

9. The device as recited in claim 6 further comprising:

a longitudinal track within said housing; and a traveler on said roller assembly and moveably coupled to said longitudinal track for guiding movement of said roller assembly.

* * * * *